United States Patent [19]

Streppel

[11] Patent Number: 4,581,883

[45] Date of Patent: Apr. 15, 1986

[54] YARN FALSE TWISTING APPARATUS

[75] Inventor: Herbert Streppel, Remscheid, Fed. Rep. of Germany

[73] Assignee: Barmag Barmer Maschinenfabrik AG, Remscheid, Fed. Rep. of Germany

[21] Appl. No.: 673,267

[22] Filed: Nov. 20, 1984

[30] Foreign Application Priority Data

Nov. 21, 1983 [DE] Fed. Rep. of Germany ..... 3341925
Apr. 10, 1984 [DE] Fed. Rep. of Germany ..... 3413441

[51] Int. Cl.[4] ..... D02G 1/02

[52] U.S. Cl. ..... 57/290; 57/284; 57/291

[58] Field of Search ..... 57/284–291, 57/90

[56] References Cited

U.S. PATENT DOCUMENTS

| | | | |
|---|---|---|---|
| Re. 30,159 | 11/1979 | Kubler | 57/291 |
| 3,516,240 | 6/1970 | Fain | 57/290 |
| 3,611,692 | 10/1971 | Kubler et al. | 57/290 |
| 3,827,228 | 8/1974 | McNeight et al. | 57/339 |
| 4,051,650 | 10/1977 | Gleyze et al. | 57/290 X |
| 4,134,252 | 1/1979 | Otaki et al. | 57/290 X |
| 4,395,872 | 8/1983 | Riedl | 57/290 X |

*Primary Examiner*—John Petrakes
*Attorney, Agent, or Firm*—Bell, Seltzer, Park & Gibson

[57] ABSTRACT

A yarn false twisting apparatus is disclosed which is adapted to produce a crimped composite yarn composed of an S twisted component and a Z twisted component, and wherein the full takeup capacity of the apparatus is utilized. The apparatus includes first and second false twisting units associated with each twisting position, with all of the first units being aligned in a first horizontal row extending along the length of the apparatus, and all of the second units being aligned in a second horizontal row. The two rows may be oriented with respect to each other, and the other elements of each twisting position, so that the paths of travel of the two components have an equal twisting length, and an equal cooling length.

13 Claims, 6 Drawing Figures

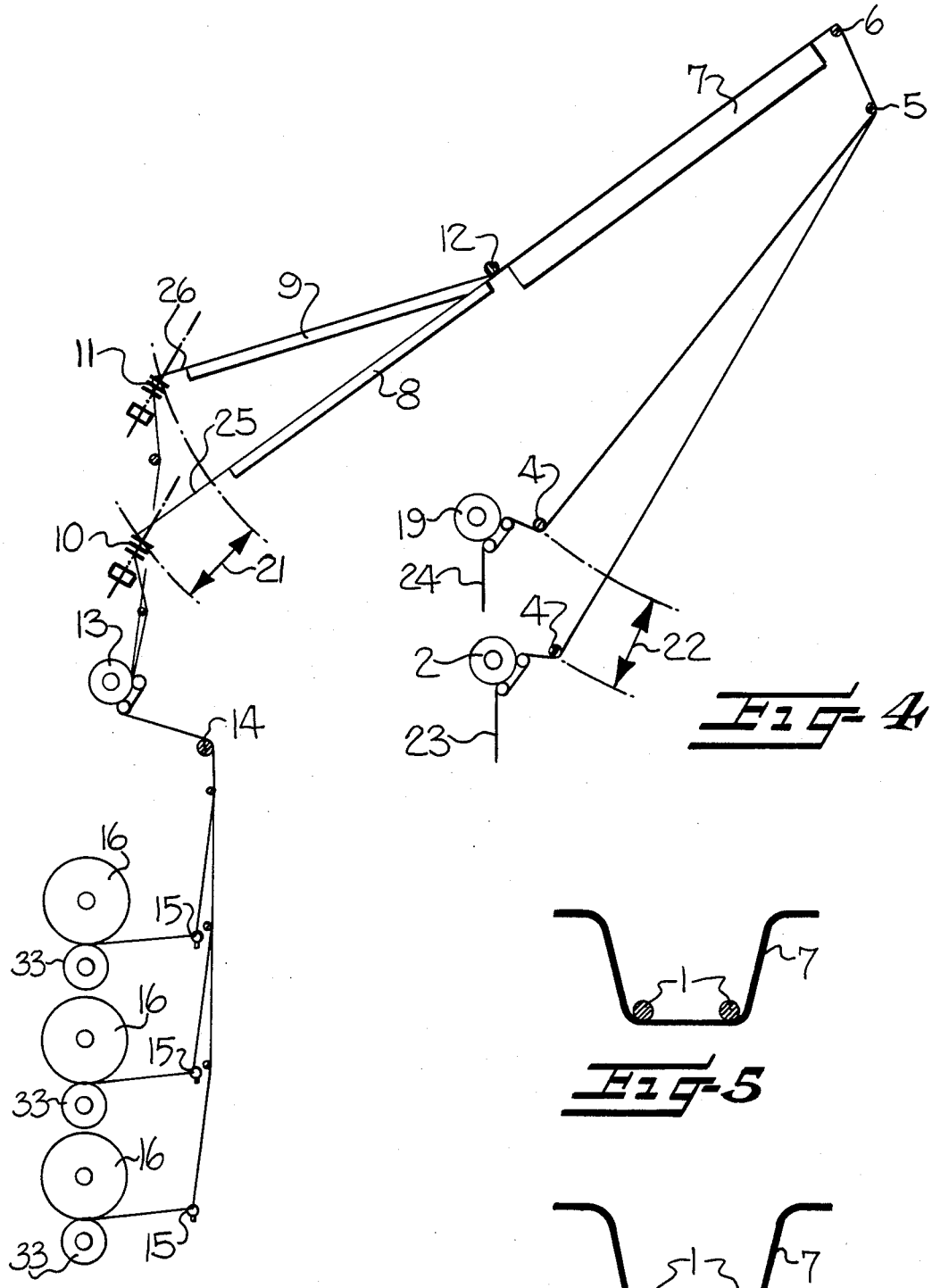
Fig-4
Fig-5
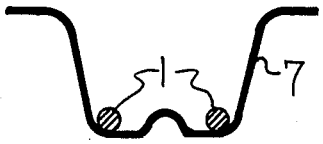
Fig-6

YARN FALSE TWISTING APPARATUS

The present invention relates to a yarn false twisting apparatus, of the type which comprises a number of side by side twisting positions wherein a running yarn is subjected to simultaneous twisting, heat setting, cooling, and untwisting operations, and which results in the twist being permanently set in the yarn. More particularly, the present invention relates to a false twisting apparatus which is adapted to produce a crimped composite yarn composed of one component which has been subjected to S twist, and a second component which has been subjected to Z twist, and such that the composite yarn has balanced torque characteristics.

It has heretofore been proposed to utilize conventional false twisting machines to produce a composite yarn composed of an S twisted component and a Z twisted component. However, existing machines are not able to be efficiently used for this purpose. In particular, existing machines comprise a horizontal row of spaced apart twisting units which are operatively driven by a common drive belt. Also, the existing machines are typically provided with vertical rows of winding stations disposed below the row of twisting units, with three winding stations in each vertical row. Thus each vertical row of three winding stations services three of the twisting units. In order to utilize a machine of this type to produce the above described composite yarn, alternate twisting units are set up to produce and S twist component and a Z twist component respectively, and the composite yarn is delivered to one of the underlying winding stations. As will be apparent, only half of the winding stations are thus utilized, and the production of the machine is thereby cut in half.

A proposal to double the number of twisting units in the existing horizontal row in order to permit utilization of all of the winding stations, would not be viable since there is insufficient room between the present twisting units for the added units. Thus for example, FIG. 3 of McNeight et al U.S. Pat. No. 3,827,228 illustrates the use of side by side twisting units which are adapted to produce S and Z twist respectively. However, the space required for the two twisting units would necessarily increase the overall length of the apparatus to an unacceptable degree.

It is accordingly an object of the present invention to provide a false twisting apparatus which is adapted to produce a composite yarn as described above, and which avoids the above noted disadvantages of the present practices.

It is a more particular object of the present invention to provide a false twisting apparatus which is capable of utilizing its full production capacity, and specifically the full takeup capacity, during production of a composite yarn of the type described above.

These and other objects and advantages of the present invention are achieved in the embodiments illustrated herein by the provision of a false twisting apparatus wherein each of the side by side twisting positions includes elongate yarn delivery means for advancing each of two yarn components from supply packages along a path of travel, which includes yarn heating means, elongate yarn cooling guide means, and first and second false twisting units disposed adjacent the outlet end of the yarn cooling guide means. One of the false twisting units is adapted to impart S twist to one of the yarn components, and the other false twisting unit is adapted to impart Z twist to the other component. All of the first false twisting units are aligned in a first horizontal row along the length of the apparatus, and all of the second false twisting units are aligned in a second horizontal row. Yarn takeup means is also provided for receiving the two advancing yarn components from the two associated false twisting units, and combining the two components into a unitary finished composite yarn, which is then wound into package form.

By the above arrangement, the yarn false twisting apparatus may be constructed so as to include a row of three winding stations below groups of three side by side twisting positions in the conventional manner, and all of the winding positions may be fully utilized so that the full production capacity of the apparatus is maintained when producing the composite yarn.

Some of the objects and advantages of the invention having been stated, others will become apparent as the description proceeds when taken in conjunction with the accompanying schematic drawings, in which:

FIG. 4 is a view similar to FIG. 1 but illustrating a further embodiment of the invention;

FIG. 5 is a fragmentary sectional view taken substantially along the line 5—5 of FIG. 2, and illustrating one embodiment of the heating apparatus; and FIG. 6 is a fragmentary view similar to FIG. 5 but illustrating a further embodiment of the heating apparatus.

Figure 1:
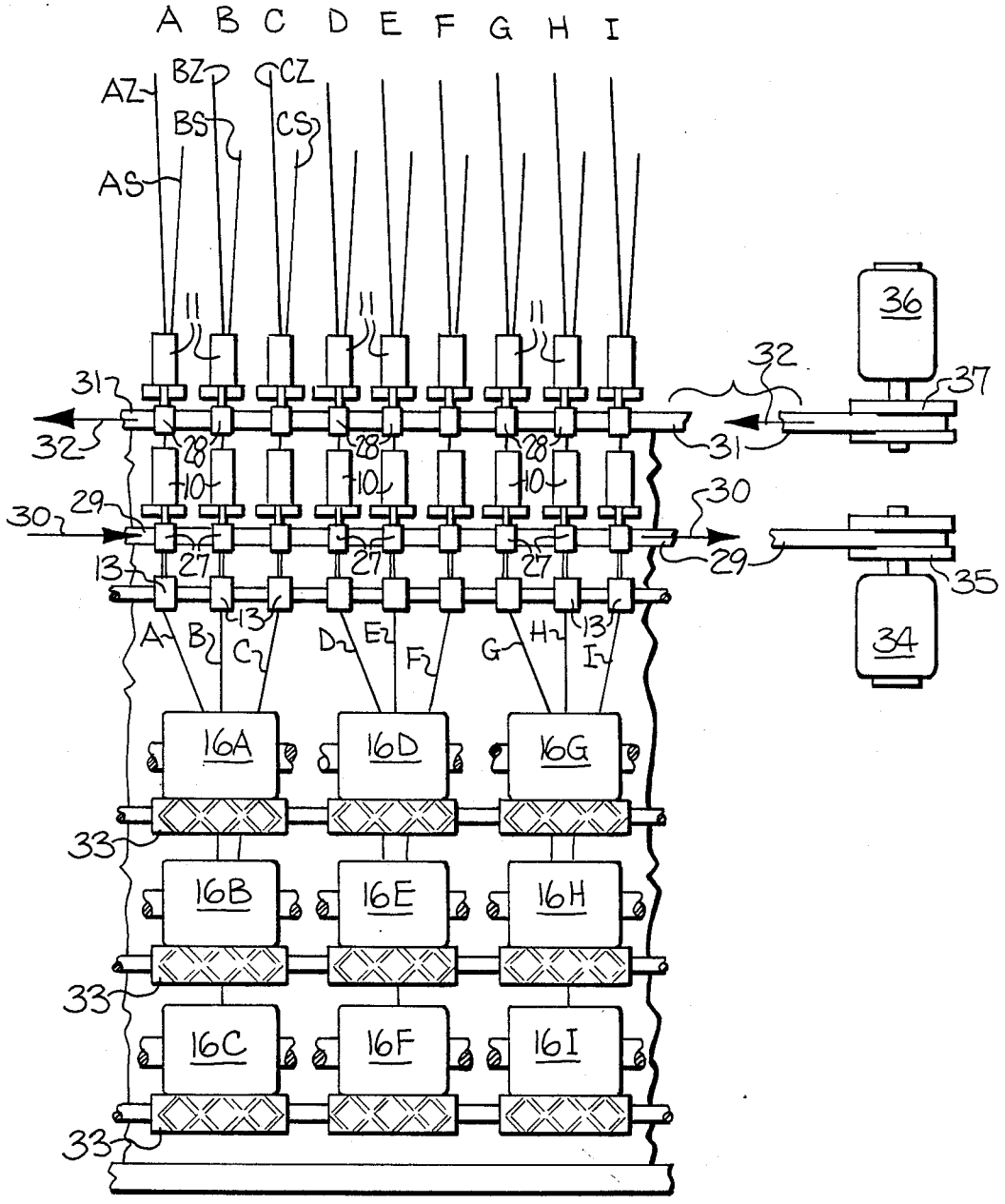
FIG. 1 is a fragmentary front elevation view of a yarn false twisting apparatus embodying the features of the present invention.
Figure 2:
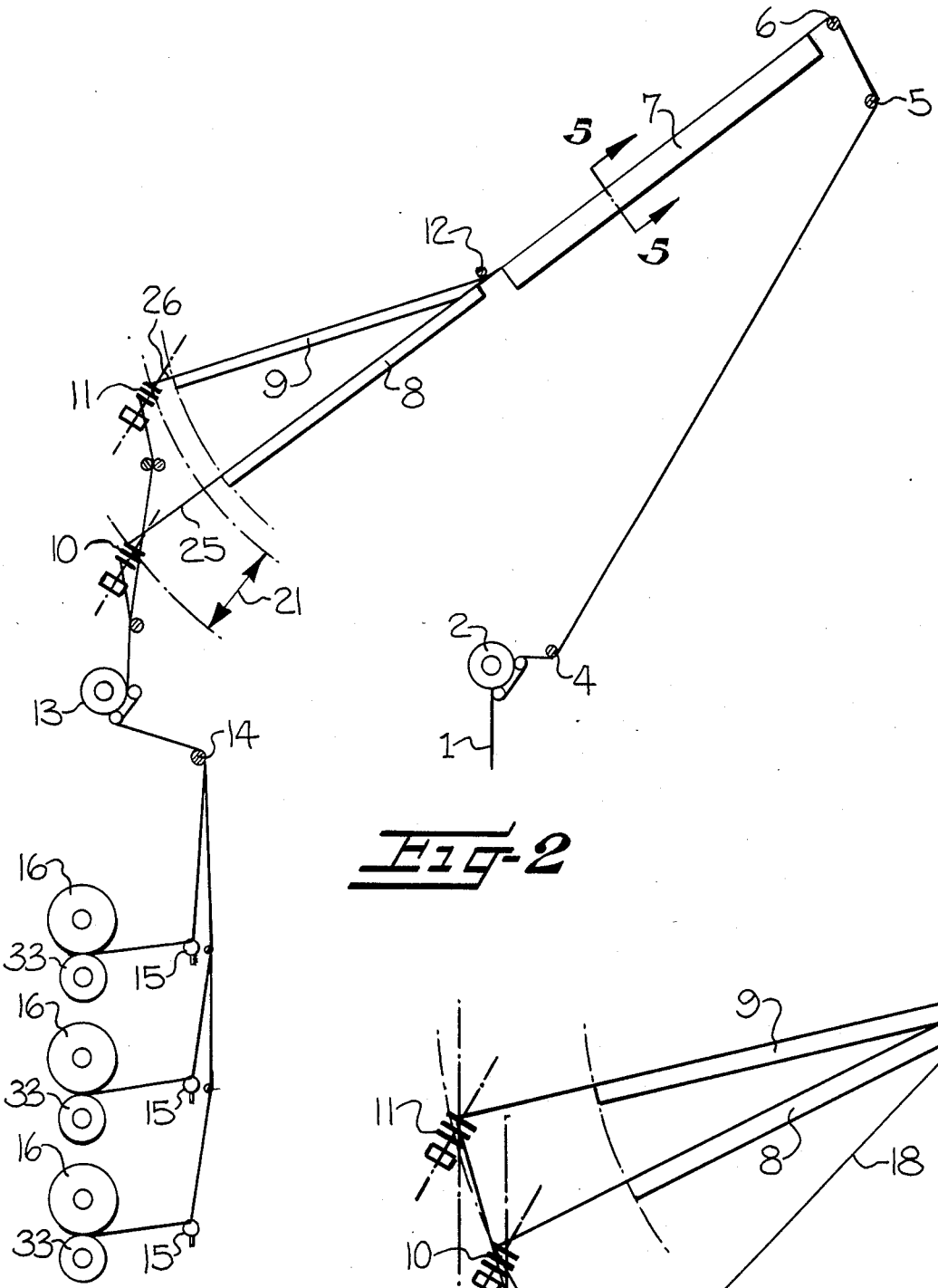
FIG. 2 is a fragmentary side elevation view of the apparatus shown in FIG. 1.

Referring more particularly to the drawings, FIGS. 1 and 2 illustrate a preferred embodiment of the invention, and which comprises a yarn false twisting apparatus composed of a plurality of side by side twisting positions, with the positions being indicated by the letters A, B, C, etc. Each twisting position includes yarn delivery means in the form of a conventional transport roller 2 and apron, which is adapted for advancing each of two yarn components 1 from supply packages (not shown) along a path of travel to the inlet end of a heating chamber 7. More particularly, upon leaving the transport roller 2, the two yarn components of the pair are separated by suitable guide means (not shown) and guided over the deflecting rolls 4, 5 and 6 to the entry end of the chamber 7.

The heating chamber 7 may include totally separate channels for the two yarn components 1. However, it is preferable that the chamber have a single channel adapted to receive both yarn components in a side by side arrangement as illustrated in FIG. 5. Since the yarn components have opposite twists, they tend to accumulate in opposite corners of the channel. In the embodiment of FIG. 6, the channel has a central ridge which divides the channel into two separate grooves, with each groove being adapted to receive one of the two yarn components 1.

Each twisting position further includes elongate yarn cooling guide members 8 and 9 for respective ones of the two yarn components, with each guide member having an inlet end adjacent the outlet end of the heating chamber 7 for receiving one of the advancing yarn components, and an opposite outlet end. As illustrated, a suitable guide roll 12 is positioned between the outlet end of the chamber 7 and the entry end of the two guide members 8 and 9. A first false twisting unit 10 is disposed adjacent the outlet end of the guide member 8 for receiving one of the advancing yarn components and imparting twist in one direction thereto, and a second false twisting unit 11 is disposed adjacent the outlet end of the guide member 9 for receiving the other of the advancing yarn components and imparting twist in the opposite direction. The twist received by the yarn components will return upstream from the false twisting units to the common yarn delivery roller 2, in a manner well known in the art. In the case of the production of certain types of yarn, such as hosiery yarn, a twist stop roll (not shown) may be used in place of the deflecting rolls 5 and 6 to limit the length of the twisted yarn components.

As best seen in FIG. 1, all of the first twisting units 10 of all of the twisting positions are aligned in a first horizontal row, and that all of the second twisting units 11 are aligned in a second horizontal row which is spaced vertically above the first row. Each false twisting unit is driven by a whorl 27 in the lower row, and a whorl 28 in the upper row. Each whorl 27 of the lower row is in driving contact with a tangential belt 29, which is driven in the direction of travel indicated by the arrow 30 by the motor 34 and drive pulley 35. Each whorl 28 of the upper row is in driving contact with a tangential belt 31 which is driven in the direction of travel indicated by the arrow 32 by means of a second motor 36 and associated drive pulley 37.

From the false twisting units 10 and 11, the yarn components are withdrawn by a common delivery roller 13 and associated apron, with the two components being plied or combined just before the delivery roller 13. From the roller 13, the composite yarn is guided by the guide members 14 and 15 and the traverse roller 33 to the take-up station 16, where the yarn is wound into a package. In the illustrated embodiment, the take-up stations for all of the twisting positions comprise three horizontal rows of stations, and the stations are also arranged in vertical tiers within the horizontal rows, with three stations in each vertical tier.

Viewing the twisting position A as seen in FIG. 1, one of the yarn components AZ is guided through the associated false twisting unit 11 of the top row to receive Z twist in the illustrated embodiment, and the other yarn component AS is guided through a false twisting unit 10 of the lower row to receive S twist. The two yarn components AZ and AS are withdrawn from their respective false twisting units by a delivery roller 13, which is common for both components, and the two components are plied or combined together. The combined composite yarn A is then guided by means of the guides 14 and 15 to the traverse roll 33 so as to be wound into a package at the take-up station 16A. The yarn components BZ and BS are correspondingly combined to form a composite yarn B which is guided to the station 16B, the yarn components CZ and CS are combined to form yarn C which is correspondingly guided to the station 16C, and so forth along the length of the machine.

In the embodiment of FIGS. 1 and 2, it will be noted that the lengths of the cooling zones between the outlet end of the heating chamber 7 and the false twisting units 10 and 11 are not uniform. In particular, it will be seen that there is an air gap 25 between the cooling member 8 and the twisting unit 10, and an air gap 26 of shorter length between the cooling member 9 and the twisting unit 11. However, it has been found that by reason of the intensive cooling in the two cooling members 8 and 9, which are of uniform length, the difference in length of the remaining air gaps 25 and 26 to the false twisting units 10 and 11 does not usually effect crimp quality to a noticeable degree. In this regard, it has been found that cooling members in the form of plates which are cooled by ambient air are generally adequate.

Figure 3:
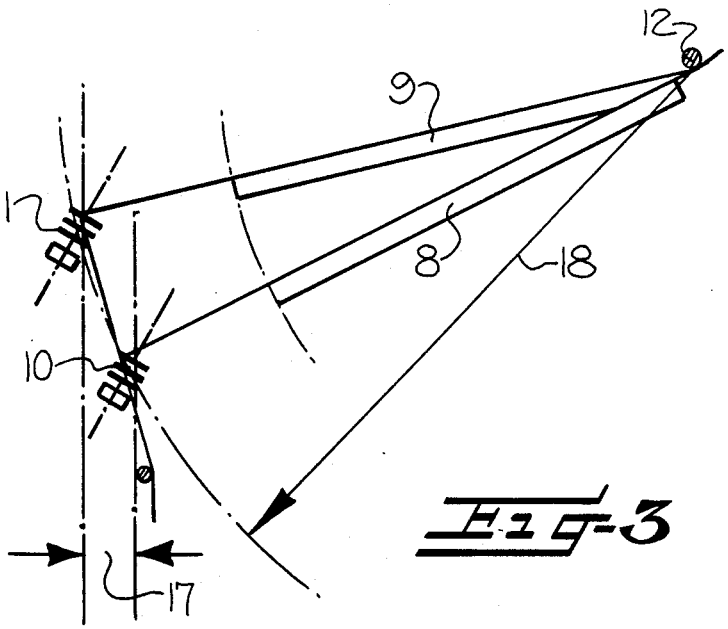
FIG. 3 is a fragmentary view of a portion of the apparatus shown in FIG. 1, but with the relative positions of the two rows of twisting units being modified.

FIG. 3 illustrates a modified arrangement of the false twisting units 10 and 11, with the upper units 11 being displaced forwardly with respect to the lower units 10 by an amount indicated at 17. This arrangement provides that the two air gaps 25 and 26, and thus the total length 18 of the cooling zones for the two components, are equal.

In FIG. 4, there is disclosed a further embodiment wherein separate yarn delivery transport rollers 2 and 19 are provided for each of the yarn components 23 and 24. This arrangement is particularly suitable, for example, when effect yarns are to be produced and which are composed of components of different composition. In such cases, the components may be subjected to different drawing or texturing conditions, and in such cases it may be also desirable to operate the false twist units 10 and 11 at different speeds. More particularly, when the delivery units comprise a transport roller and apron as illustrated, it is possible to juxtapose the two units in a side by side arrangement by reason of their small width, without causing a substantial change in the geometric conditions of the overall apparatus. FIG. 4 however illustrates a different arrangement of the two feed rollers 2 and 19, which is also advantageous. In this case, the second feed roller 19 is positioned above the first feed roller 2. Also, the rollers 2 and 19 are spaced apart such that the difference 22 in the path of travel between the guide members 4 and 5, or between the exits of the feed rollers and the guide member 5, equals the difference of length 21 between the two cooling zones. In this manner, the two false twisting lengths between the exits of the delivery systems 2 and 19 and the false twisting units 10 and 11 are substantially the same. In this regard, the same length of the false twisting zones may also be obtained by replacing the guide rolls 5 and 6 with twist stop members which are staggered relative to each other in accordance with the distance to the false twist assemblies 10 and 11.

In all of the described embodiments of the invention, the yarn components passing through the delivery roller 2, or the rollers 2 and 19, continue their travel as individual yarn components from the false twist units 10 and 11 to the common delivery system 13, where they are combined and then jointly guided via the yarn guide members 14 and 15 to the take-up station 16. As compared to the prior art systems, the steps of the present invention result in the output of the machine being fully utilized with respect to its take-up capacity when the described composite yarn is produced. Thus the production per machine is effectively doubled. Also, the resulting yarn exhibits a high crimp frequency which cannot be obtained by the twisting of a yarn having the total denier of the composite yarn. Thus for example, in a composite yarn with a total denier of 156 dtex, the yarn components may be false twisted to 3200 twists per meter, whereas only 2300 twists per meter would be obtained if the two components were jointly twisted as a composite yarn.

It is also within the scope of the present invention that each winding position may include an additional heater positioned between the delivery roller 13 and the take-up package 16, as illustrated for example in the U.S. patents to Kubler, U.S. Pat. Nos. 3,611,692 and RE 30,159.

In the drawings and specification, there has been set forth preferred embodiments of the invention, and although specific terms are employed, they are used in a generic and descriptive sense only and not for purposes of limitation.

That which is claimed is:

1. A yarn false twisting apparatus comprising a plurality of side-by-side twisting positions, with each twisting position including:

(a) yarn delivery means for advancing each of two yarn components from supply packages and along a path of travel, (b) elongate yarn heating means positioned along said path of travel and having an inlet end for receiving the advancing yarn components, and an outlet end, (c) elongate yarn cooling guide means positioned along said path of travel and having an inlet end and an outlet end, with the inlet end of said guide means being disposed adjacent the outlet end of said heating means for receiving the advancing yarn components therefrom, (d) a first false twisting unit disposed adjacent the outlet end of said yarn cooling guide means for receiving one of the advancing yarn components from said cooling means and imparting S twist thereto, (e) a second false twisting unit disposed adjacent the outlet end of said yarn cooling means for receiving the other of the advancing yarn components from said cooling means and imparting Z twist thereto, and (f) yarn take-up means for receiving the two advancing yarn components from said first and second false twisting units and combining the two components into a composite finished yarn having balanced twist characteristics, and winding the composite yarn into package form, and said first false twisting units of all of said twisting positions being aligned in a first horizontal row, and said second false twisting units of all of said twisting positions being aligned in a second horizontal row, and with one of said rows being positioned above the other of said rows.

2. The false twisting apparatus as defined in claim 1 wherein said apparatus further comprises first drive means operatively associated with all of said first twisting units in said first row, and second drive means operatively associated with all of said second twisting units in said second row.

3. The false twisting apparatus as defined in claim 2 wherein said yarn heating means of each twisting position comprises a single heating member having a channel adapted to receive both of the yarn components in a side-by-side arrangement.

4. The false twisting apparatus as defined in claim 3 wherein said channel in said heating chamber has a central ridge which divides the channel into two separate grooves, with each groove being adapted to receive one of the two yarn components.

5. The false twisting apparatus as defined in claim 3 wherein said cooling guide means of each twisting position comprises first and second separate guide members.

6. The false twisting apparatus as defined in claim 5 wherein said two separate guide members are angularly oriented with respect to each other, and so that each guide member extends from a point adjacent the outlet end of said heating means directly toward the associated false twisting unit.

7. The false twisting apparatus as defined in claim 1 wherein said two rows of false twisting units are arranged with respect to each other such that the length of the path of travel between said yarn delivery means and the associated false twisting unit is substantially the same for each yarn component.

8. The false twisting apparatus as defined in claim 1 wherein said yarn delivery means for each twisting position comprises a single transport roller.

9. The false twisting apparatus as defined in claim 1 wherein said yarn delivery means for each twisting position comprises a separate transport roller for each of said yarn components.

10. The false twisting apparatus as defined in claim 9 wherein the length of the yarn path of travel between the transport roller and the associated false twisting unit is substantially the same for each yarn component.

11. The false twisting apparatus as defined in claim 1 wherein said yarn take-up means for all of said twisting positions comprises a plurality of horizontal rows of take-up stations.

12. The false twisting apparatus as defined in claim 11 wherein said take-up stations are arranged in vertical tiers within said horizontal rows, with at least three stations in each vertical tier.

13. The false twisting apparatus as defined in claim 1 wherein said first and second false twisting units of each twisting position are arranged to lie in a common vertical plane.

* * * * *